US005688755A

United States Patent [19]

Ikeda et al.

[11] Patent Number: 5,688,755

[45] Date of Patent: Nov. 18, 1997

[54] ACIDIC CLEANING AQUEOUS SOLUTION FOR ALUMINUM AND ALUMINUM ALLOY AND METHOD FOR CLEANING THE SAME

[75] Inventors: Satoshi Ikeda, Yamato; Masayuki Kamimura, Ichikawa, both of Japan

[73] Assignee: Nippon Paint Co., Ltd., Osaka, Japan

[21] Appl. No.: 661,143

[22] Filed: Jun. 10, 1996

Related U.S. Application Data

[63] Continuation of Ser. No. 280,836, Jul. 26, 1994, abandoned.

[30] Foreign Application Priority Data

Jul. 30, 1993 [JP] Japan ..... 5-190476

[51] Int. Cl.[6] ..... C11D 1/66; C11D 7/08; C11D 7/50

[52] U.S. Cl. ..... 510/254; 510/255; 510/270; 510/271; 510/421; 510/508; 134/3; 134/41

[58] Field of Search ..... 510/254, 255, 510/270, 271, 421, 508; 134/3, 41

[56] References Cited

U.S. PATENT DOCUMENTS

| | | | |
|---|---|---|---|
| Re. 27,662 | 6/1973 | Hamilton | 252/79.4 |
| 1,984,534 | 12/1934 | Larsen | 148/8 |
| 3,635,826 | 1/1972 | Hamilton | 252/79.4 |
| 3,767,491 | 10/1973 | Chough | 156/5 |
| 3,969,258 | 7/1976 | Carandang et al. | 252/106 |
| 4,032,466 | 6/1977 | Otrhalek et al. | 252/136 |
| 4,059,678 | 11/1977 | Winkley | 423/273 |
| 4,169,068 | 9/1979 | Harita et al. | 252/143 |
| 4,435,223 | 3/1984 | Dollman | 134/3 |
| 4,668,421 | 5/1987 | Dollman | 252/136 |
| 4,675,125 | 6/1987 | Sturwold | 252/118 |
| 4,728,456 | 3/1988 | Yamasoe et al. | 252/142 |
| 4,851,148 | 7/1989 | Yamasoe et al. | 252/142 |
| 4,886,616 | 12/1989 | Yamasoe et al. | 252/142 |
| 4,956,022 | 9/1990 | Mahmoud | 134/41 |
| 4,965,009 | 10/1990 | Baur et al. | 252/142 |
| 4,980,076 | 12/1990 | Tamaka et al. | 252/79.4 |
| 5,030,323 | 7/1991 | Awad | 156/665 |
| 5,064,500 | 11/1991 | Awad | 156/665 |
| 5,336,425 | 8/1994 | Aoki et al. | 252/100 |
| 5,393,447 | 2/1995 | Carlson | 252/101 |
| 5,607,913 | 3/1997 | Woo et al. | 510/413 |

FOREIGN PATENT DOCUMENTS

| | | |
|---|---|---|
| 0180908 | 5/1986 | European Pat. Off. . |
| 0196668 | 10/1986 | European Pat. Off. . |
| 0361102 | 4/1990 | European Pat. Off. . |
| WO91/19830 | 12/1991 | WIPO . |

*Primary Examiner*—Ardith Hertzog
*Assistant Examiner*—Gregory R. Delcotto
*Attorney, Agent, or Firm*—Sughrue,Mion,Zinn,Macpeak & Seas, PLLC

[57] ABSTRACT

An acidic cleaning aqueous solution for carrying out a low temperature acidic cleaning of aluminum and aluminum alloy and a cleaning method for the same free from harmful fluorine and chromium ions. The acidic cleaning aqueous solution includes oxidized metal ions as an etching promoter, an inorganic acid, a surfactant and a certain amount of polyhydric alcohols having at least two hydroxyl groups directly coupled with two adjacent carbon atoms of a principal chain within one molecule and further includes an oxidizing agent for oxidizing the oxidized metal ions reduced in the cleaning. Certain alcohols in the acidic cleaning aqueous solution can control the oxidative decomposition reaction of the surfactant to obtain a long life acidic cleaning aqueous solution.

10 Claims, No Drawings

ACIDIC CLEANING AQUEOUS SOLUTION FOR ALUMINUM AND ALUMINUM ALLOY AND METHOD FOR CLEANING THE SAME

This is a Continuation of application Ser. No. 08/280,836 filed Jul. 26, 1994, now abandoned.

BACKGROUND OF THE INVENTION i) Field of the Invention

The present invention relates to an acidic cleaning aqueous solution for aluminum and aluminum alloy and a method for cleaning the same, and more particularly to a cleaning aqueous solution capable of satisfactorily removing lubricating oil and aluminum powder or smut adhering on aluminum surface due to fabrication and a cleaning method for the same.

ii) Description of the Related Arts

Aluminum products such as beverage containers made of aluminum or aluminum alloy are ordinarily manufactured by a metal-forming operation called "drawing and ironing" (hereinafter referred to as DI processing). In this metal-forming operation, a lubricating oil is applied to the metal surface and aluminum powder (smut) adheres to the resulting container, particularly to its internal walls. The surface of this kind of container is usually protected by, for example, a chemical conversion treatment or coating. Hence, prior to this treatment or coating, it is necessary to remove the lubricating oil and the smut from the metal surface to clean the same.

In general, an acidic cleaning agent to appropriately etch the metal surface is used in this surface cleaning. Conventionally, as such an acidic cleaning agent, a chromic acid type or a hydrofluoric acid type cleaning agent has frequently been used. In particular, the hydrofluoric acid cleaning agent is superior in permitting a low temperature acidic cleaning (up to 50° C.). However, since these acidic cleaning agents are harmful and their waste water is strictly regulated, recently, the establishment of a chromium free and fluorine free low temperature acidic cleaning technique has been desired.

Such a chromium free and fluorine free low temperature acidic cleaning technique has been proposed as "Aluminum Surface Cleaning Agent" disclosed in U.S. Pat. No. 4,728,456 and "Method Of Controlling An Aluminum Surface Cleaning Composition" disclosed in U.S. Pat. No. 4,851,148.

That is, in these two patents, a chromium free cleaning composition consisting of an acidic cleaning agent containing little or no fluoride ions and having its pH regulated to 2.0 or less with sulfuric and/or nitric acid, and ferric ions for promoting an etching in place of the fluoride ions, and a method for controlling an oxidation-reduction potential of a cleaning bath to control a ferric ion concentration in the bath are disclosed.

Usually, an etching reaction of aluminum in an acidic cleaning solution is composed of an anode reaction in which aluminum becomes aluminum ion ($Al \rightarrow Al^{3+}+3e^-$) and a cathode reaction in which $H^+$ in the cleaning solution is reduced to produce ½ $H_2$ ($H^++e^- \rightarrow ½ H_2$). Hence, when a ferric salt ($Fe^{3+}$) is added into the acidic cleaning solution, the anode reaction which reduces $Fe^{3+}$ to $Fe^{2+}$ simultaneously takes place with the reduction of $H^+$ and the etching reaction of aluminum is thus promoted. Moreover, the control of the oxidation-reduction potential of the cleaning bath by an oxidizing agent to control the ferric ion concentration permits retarding of the $Fe^{2+}$ concentration which is increasing as the etching reaction of aluminum proceeds and enabling of the oxidization of $Fe^{2+}$ to $Fe^{3+}$.

However, in general, it is known that the oxidizing agent oxidizes and decomposes surfactants. Accordingly, when the oxidizing agent is added into the acidic cleaning aqueous solution containing the surfactants in order to improve degreasing ability, decomposition products accumulate in the cleaning bath and the degreasing ability on the aluminum surfaces is reduced. On the other hand, the addition of an excessive amount of surfactant in order to maintain the degreasing ability leads to running cost increase.

Further, as disclosed in WO 91-19830, "Acidic liquid composition and process for cleaning aluminum" containing a mineral acid selected from the group consisting of phosphoric acid, sulfuric acid and nitric acid, multiply changed metal ions, a surfactant and an oxidizing agent for oxidizing the multiply changed metal ions reduced in the cleaning and also containing 0.05 to 5 g/l of $C_2$ to $C_{10}$ glycols for inhibiting the decomposition reaction of the surfactant by the oxidizing agent has been proposed.

However, in this case, all the $C_2$ to $C_{10}$ glycols do not always inhibit the decomposition reaction of the surfactant by the oxidizing agent. For instance, when using trimethylene glycol ($HOCH_2CH_2CH_2OH$) having a configuration with two hydroxyl groups attached to both end carbons of a principal chain, this trimethylene glycol is oxidized by the oxidizing agent to produce propionaldehyde. As a result, on the contrary, the usage amount of the oxidizing agent increases to enlarge the running cost.

Also, even when diethylene glycol ($HO(CH_2)_2O(CH_2)_2OH$) or triethylene glycol ($HO(CH_2CH_2O)_2CH_2CH_2OH$) is used, the glycol is oxidized to an aldehyde by the oxidizing agent in the same manner as above, resulting in increasing of the usage amount of the oxidizing agent and of the running cost.

SUMMARY OF THE INVENTION

It is therefore an object of the present invention to provide an acidic cleaning aqueous solution for aluminum and aluminum alloy in view of the aforementioned problems of the prior art, which is free from chromium ions and fluorine ions which are harmful and readily cause a public hazard and pollution of the working environment, and which is capable of removing lubricating oil and smut adhered to an aluminum surface to clean the same.

It is another object of the present invention to provide a method for cleaning surfaces of aluminum and aluminum alloy, which is free from chromium ions and fluorine ions which are harmful and readily cause a public hazard and pollution of the working environment, and which is capable of removing lubricating oil and smut adhered to an aluminum surface to clean the same.

The present invention provides a acidic cleaning aqueous solution for aluminum and aluminum alloy and a cleaning method for the same having the following features.

(1) An acidic cleaning aqueous solution for aluminum and aluminum alloy, comprising:

(a) at least one inorganic acid to produce a pH of at most 2 for the acidic cleaning aqueous solution;

(b) oxidized metal ions;

(c) at least one surfactant; and (d) 0.1 to 5 g/l of at least one polyhydric alcohol having at least two hydroxyl groups directly coupled with respective two adjacent carbon atoms of a principal chain within one molecule.

(2) The acidic cleaning aqueous solution mentioned in (1) above, wherein the (d) polyhydric alcohol includes at least one trihydric alcohol having at least two hydroxyl groups directly coupled with the two adjacent carbon atoms of the principal chain within one molecule.

(3) The acidic cleaning aqueous solution mentioned in (2) above, wherein the trihydric alcohol includes at least one of propanetriol and 1,2,4-butanetriol.

(4) The acidic cleaning aqueous solution mentioned in (1) above, wherein (d) the polyhydric alcohol includes a mixture of (e) at least one dihydric alcohol having at least two hydroxyl groups directly coupled with the two adjacent carbon atoms of the principal chain within one molecule and (f) at least one trihydric alcohol having at least two hydroxyl groups directly coupled with the two adjacent carbon atoms of the principal chain within one molecule.

(5) The acidic cleaning aqueous solution mentioned in (4) above, wherein (e) the dihydric alcohol includes at least one of 1,2-ethanediol, 1,2-propanediol, 1,2-pentanediol and 1,2-butanediol and (f) the trihydric alcohol includes at least one of 1,2,3-propanetriol and 1,2,4-butanetriol.

(6) The acidic cleaning aqueous solution mentioned in (1) above, wherein (a) the inorganic acid includes at least one of sulfuric acid, nitric acid and phosphoric acid.

(7) The acidic cleaning aqueous solution mentioned in (1) above, wherein (b) the oxidized metal ions include at least one of ferric ions, metavanadic ions, ceric ions, cobalt (V) ions and tin (IV) ions.

(8) The acidic cleaning aqueous solution mentioned in (1) above, wherein (c) the surfactant is a nonionic surfactant.

(9) The acidic cleaning aqueous solution mentioned in any one of (1), (2), (4), (6), (7) and (8) above, further comprising an ORP control oxidizing agent.

(10) The acidic cleaning aqueous solution mentioned in (9) above, wherein the oxidation reduction potential control oxidizing agent includes at least one of hydrogen peroxide, persulfates, ozone, cerium compounds, nitrites and metavanadic ions.

(11) The acidic cleaning aqueous solution mentioned in (1) above, wherein (a) the inorganic acid is sulfuric acid;

(b) the oxidized metal ions include at least one of ferric ions and metavanadic ions;

(c) the surfactant is a nonionic surfactant; and (d) the polyhydric alcohol includes at least one of 1,2,8-propanetriol and 1,2,4-butanetriol.

(12) The acidic cleaning aqueous solution mentioned in (1), wherein a content of (d) the polyhydric alcohol in the acidic cleaning aqueous solution is 0.2 to 3 g/l.

(13) The acidic cleaning aqueous solution mentioned in (1), wherein an amount of (a) the inorganic acid in the acidic cleaning aqueous solution is determined so that the pH of the acidic cleaning aqueous solution is within a range of 0.6 to 2.0;

a content of (b) the oxidized metal ions in the acidic cleaning aqueous solution is 0.2 to 5 g/l;

a content of (c) the surfactant in the acidic cleaning aqueous solution is 0.2 to 5 g/l; and a content of (d) the polyhydric alcohol in the acidic cleaning aqueous solution is 0.2 to 3 g/l.

(14) A method for cleaning an aluminum surface, comprising:

a step (1) for using an acidic cleaning aqueous solution for aluminum and aluminum alloy, including:

(a) at least one inorganic acid to produce a pH of at most 2 of the acidic cleaning aqueous solution;

(b) oxidized metal ions;

(c) at least one surfactant; and (d) 0.1 to 5 g/l of at least one polyhydric alcohol having at least two hydroxyl groups directly coupled with respective two adjacent carbon atoms of a principal chain within one molecule;

a step (2) for measuring an oxidation-reduction potential of the acidic cleaning aqueous solution; and a step (3) for supplying either a combination of (b) the oxidized metal ions and (e) an oxidation-reduction potential control oxidizing agent or (e) the ORP control oxidizing agent into the acidic cleaning aqueous solution while conducting step (2) to maintain and control a concentration of the oxidized metal ions in the acidic cleaning aqueous solution.

(15) The method for cleaning an aluminum surface mentioned in (14), wherein the polyhydric alcohol includes at least one of 1,2,3-propanetriol and 1,2,4-butanetriol. (16) The method for cleaning an aluminum surface mentioned in (14), wherein either the combination of (b) the oxidized metal ions and (e) the oxidation-reduction potential control oxidizing agent or (e) the ORP control oxidizing agent is supplied into the acidic cleaning aqueous solution while maintaining step (b) to maintain and control the concentration of the oxidized metal ions in the acidic cleaning aqueous solution so that a value of the oxidation-reduction potential of the acidic cleaning aqueous solution for the aluminum and aluminum alloy is within a range of 0.5 to 0.8 V (silver-silver chloride electrode potential reference (vs. Ag/AgCl)).

(17) The method for cleaning an aluminum surface mentioned in (14), wherein (a) the inorganic acid includes at least one of sulfuric acid and nitric acid.

(18) The method for cleaning an aluminum surface mentioned in (14), wherein (b) the oxidized metal ions includes at least one of ferric ions and metavanadic ions.

(19) The method for cleaning an aluminum surface mentioned in (14), wherein (c) the surfactant is a nonionic surfactant.

(20) The method for cleaning an aluminum surface mentioned in (14), wherein a cleaning treatment temperature is 35° C. to 80° C.

Further, the present invention provides an acidic cleaning aqueous solution for aluminum and aluminum alloy, containing an oxidizing agent in the acidic cleaning aqueous solution having the aforementioned compositions.

Moreover, in the method for cleaning an aluminum surface, by using an acidic cleaning aqueous solution for aluminum and aluminum alloy, including (a) at least one inorganic acid to produce a pH of at most 2 of The acidic cleaning aqueous solution; (b) oxidized metal ions; (c) at least one surfactant; and (d) 0.1 to 5 g/l of at least one polyhydric alcohol having at least two hydroxyl groups directly coupled with respective two adjacent carbon atoms of a principal chain within one molecule, either a combination of (b) the oxidized metal ions and (e) an oxidizing agent or (e) the oxidizing agent is supplied into the acidic cleaning aqueous solution, and an oxidation-reduction potential of the acidic cleaning aqueous solution is measured to maintain and control a concentration of the oxidized metal ions in the acidic cleaning aqueous solution.

Further, other aspects of the present invention will be described.

(21) The acidic cleaning aqueous solution mentioned in (2) above, wherein the trihydric alcohol is 1,2,3-propanetriol.

(22) The acidic cleaning aqueous solution mentioned in (4) above, wherein (e) the dihydric alcohol includes at least one of 1,2-propanediol and (f) the trihydric alcohol is 1,2,4-butanetriol.

(23) The acidic cleaning aqueous solution mentioned in (1) above, wherein (b) the oxidized metal ions include at least one of ferric ions and metavanadic ions.

(24) The acidic cleaning aqueous solution mentioned in (8) above, wherein the nonionic surfactant includes at least one of ethoxylated alkylphenols, hydrogen carbonate derivatives and abietic acid derivatives.

(25) The acidic cleaning aqueous solution mentioned in (1) above, wherein (a) the inorganic acid is sulfuric acid;

(b) the oxidized metal ions include at least one of ferric ions and metavanadic ions;

(c) the surfactant is a nonionic surfactant; and (d) the polyhydric alcohol includes a mixture of (e) at least one dihydric alcohol including at least one of 1,2-ethanediol, 1,2-propaneriol, 1,2-pentanediol and 1,2-butanediol and (f) at least one trihydric alcohol including at least one of 1,2,3-propanetriol and 1,2,4-butanetriol.

(26) The acidic cleaning aqueous solution mentioned in (1), wherein the pH of the acidic cleaning aqueous solution is 0.6 to 2.0.

(27) The acidic cleaning aqueous solution mentioned in (1), wherein a content of (b) the oxidized metal ions in the acidic cleaning aqueous solution is 0.2 to 4 g/l.

(28) The acidic cleaning aqueous solution mentioned in (1), wherein a content of (b) the oxidized metal ions in the acidic cleaning aqueous solution is 0.5 to 2 g/l.

(29) The acidic cleaning aqueous solution mentioned in (1), wherein a content of (c) the surfactant in the acidic cleaning aqueous solution is 0.1 to 10 g/l.

(30) The acidic cleaning aqueous solution mentioned in (1), wherein a content of (c) the surfactant in the acidic cleaning aqueous solution is 0.5 to 2 g/l.

(31) The acidic cleaning aqueous solution mentioned in (5), wherein a weight ratio between (f) the trihydric alcohol and (e) the dihydric alcohol is 1/2 to 2/1.

(32) The method for cleaning an aluminum surface mentioned in (14), wherein (d) the polyhydric alcohol includes a mixture of:

at least one dihydric alcohol including 1,2-ethanediol, 1,2-propanediol, 1,2-pentanediol and 1,2-butanediol; and at least one trihydric alcohol including 1,2,3-propanetriol and 1,2,4-butanetriol.

DESCRIPTION OF THE PREFERRED EMBODIMENTS

The present invention will now be described in connection with its preferred embodiments.

The present invention provides an acidic cleaning aqueous solution for aluminum and aluminum alloy and a method for cleaning the surfaces of the aluminum and aluminum alloy.

According to the present invention, the acidic cleaning aqueous solution can be used as a cleaning bath for cleaning aluminum and aluminum alloy materials and a concentrated solution of the acidic cleaning aqueous solution is diluted with a proper amount of water to a certain range of concentration to obtain the cleaning bath.

First, as an inorganic acid, sulfuric acid, nitric acid and phosphoric acid are given.

As oxidized metal ions, ferric ions ($Fe^{3+}$), metavanadic ions ($VO_3^-$), ceric ions ($Ce^{4+}$), cobalt (V) ions ($Co^{5+}$), tin (IV) ions ($Sn^{4+}$) and the like are given, preferably ferric ions ($Fe^{3+}$) and metavanadic ions ($VO_3^-$). In this case, in the case of metal having a plurality of valences, the oxidized metal ions indicate those having the higher valence.

As the source of the ferric ions, water-soluble ferric salts such as ferric sulfate, ferric nitrate, ferric perchlorate and the like are given. As the source of the metavanadic ions, sodium metavanadate, potassium metavanadate, ammonium metavanadate and the like are given. As the source of the cerimetric ions, ammonium cerium and the like are given. As the source of the cobalt (V) ions, cobalt (III) sulfate, cobalt (III) ammonium sulfate and the like are given. As the source of the tin (IV) ions, tin (IV) sulfate, tin (IV) nitrate and the like are given.

Concerning a surfactant, any kinds of surfactant such as nonionic, cationic, anionic and amphoteric surfactants can be used in the same manner as conventional cases. Of these surfactants, particularly, nonionic ones such as ethoxylated alkylphenols, hydrogen carbonate derivatives, abietic acid derivatives, primary ethoxylated alcohols, modified polyethoxylated alcohols and the like are preferably used.

Ordinarily, when the cleaning is carried out, the ferric ions are changed to the ferrous ions as $Fe^{3+}+e^- \rightarrow Fe^{2+}$ with the passage of time and the oxidation-reduction potential drops (also called the aging of the cleaning bath), resulting in vanishing of the etching promotion effect of the aluminum surface. As to the metavanadic ions, similarly, the cleaning bath ages with elapsed time. Further, when the ferric ions are used as a cathode depolarizer, the ferric ions can be supplied at any time or an ORP (oxidation-reduction potential) control oxidizing agent can be added at any time so as to oxidize the ferrous ions to the ferric ions. In this case, as the oxidation-reduction potential control oxidizing agent, hydrogen peroxide ($H_2O_2$), persulfates such as $Na_2S_2O_8^{2-}$, ozone ($O_3$), cerium compounds such as ammonium cerium sulfate ($(NH_4)_4Ce(SO_4)_4$), nitrites such as $NANO_2$ and $KNO_2$, compounds for producing the metavanadic ions ($VO_3^-$), and the like are given. These oxidizing agents are disclosed in U.S. Pat. No. 4,851,148.

As polyhydric alcohols having at least two hydroxyl groups directly linked with the two adjacent carbon atoms of the principal chain within one molecule, dihydric alcohols such as 1,2-ethanediol (ethylene glycol), 1,2-propanediol (propylene glycol), 1,2-pentanediol and 1,2-butanediol; trihydric alcohols such as 1,2,3-propanetriol (glycerin) and 1,2,4-butanetriol; and tetrahydric alcohols such as 1,2,3,4-butanetetraol and the like are given.

Also, the pH of the acidic cleaning aqueous solution of the present invention is preferably controlled to 2 or less, more preferably to 0.6 to 2. If the pH is more than 2, the etching rate of the aluminum surface is lowered extremely and it is difficult to exhibit effective power as the cleaning bath. On the other hand, if the pH is less than 0.6, economical efficiency degrades and a carry-in amount to the next chemical conversion step increases, which may bring about defective chemical conversion.

The content of the oxidized metal ion in the acidic cleaning aqueous solution is preferably 0.2 to 4 g/l, more preferably 0.5 to 2 g/l. If the oxidized metal ion content is less than 0.2 g/l, the etching amount is insufficient and desmutting ability, is apt to be reduced. In turn, if the content is more than 4 g/l, no further improved difference can be observed in the cleaning ability, which is not economical.

Concerning the surfactant, its content in the acidic cleaning aqueous solution is preferably 0.1 to 10 g/l, more preferably 0.5 to 2 g/l. If the surfactant content is less than 0.1 g/l, the cleaning power, particularly the degreasing ability, is inclined to reduce. On the other hand, if the content is more than 10 g/l, no further improved difference can be observed in the cleaning power and it is not economical.

The content of the polyhydric alcohols having at least two hydroxyl groups directly coupled with the two adjacent carbon atoms of the principal chain within one molecule in the acidic cleaning aqueous solution is preferably 0.1 to 5 g/l, more preferably 0.2 to 3 g/l. If the polyhydric alcohol content is less than 0.1 g/l, the oxidative decomposition reaction control effect tends to become insufficient. If the content is more than 5 g/l, no further improved difference can be observed in the cleaning ability and it is not economical. Moreover, the polyhydric alcohol concentration increases and the burden of the waste water treatment increases.

According to the present invention, as the decomposition control agent of the surfactant by the oxidizing agent, a small amount of bromine ion ($Br^-$) can be further added.

The oxidation-reduction potential of the acidic cleaning bath is preferably controlled to 0.5 to 0.8 V (vs. Ag/AgCl). If the ORP is less than 0.5 V, the oxidized metal ion amount is insufficient and hence the etching amount of the aluminum surface is liable to drop. On the other hand, if the oxidation-reduction potential is more than 0.8 V, it falls in the economical efficiency.

In the acidic cleaning bath, when only the ferrous ions are being newly supplied, the ferrous ions are accumulated, and as a result, the acidic cleaning bath gets muddy. Also, the precipitates derived from the ferrous ions are produced to deteriorate the treatment workability. Furthermore, the product to be treated, such as aluminum, when being taken out of the acidic cleaning bath carries the ferric or ferrous ions into the following step and it occurrence of precipitate in the next step is apprehended or bad influence on the chemical conversion treatment is likely. Hence, a combination of the oxidized metal ions and the oxidizing agent or only the oxidizing agent is supplied to the acidic cleaning bath to control so that the oxidation-reduction potential may be within the above-described preferable range. As a result, the aforementioned problem can be solved.

According to the present invention, the acidic cleaning aqueous solution can be applied to the aluminum surface by a spray or immersion method. The treating temperature in the acidic cleaning operation is preferably 35° to 80° C., more preferably 50° to 70° C. If the treating temperature is beyond 80° C., excessive etching occurs and the aging of the treating bath is accelerated. If the treating temperature is less than 35° C., the etching amount is insufficient and the desmutting ability is reduced.

The treating time of the acidic cleaning is preferably 30 to 300 seconds. If the treating time is more than 800 seconds, excessive etching occurs and the aging of the treating bath is accelerated. If the treating time is less than 30 seconds, the

TABLE 1

| | Inorganic acid | | Oxidized metal ion | | Polyhydric alcohol | | Nonionic surfactant | | | | | Oxidation efficiency | Cleaning power: External appearance | Cleaning power: Water wettability (%) | Cleaning power: Desmutting ability |
|---|---|---|---|---|---|---|---|---|---|---|---|---|---|---|---|
| | $H_2SO_4$ (g/l) | $HNO_3$ (g/l) | $Fe^{2+}$ (g/l) | $Ce^{3+}$ (g/l) | kind | (g/l) | kind | (g/l) | kind | (g/l) | pH | | | | |
| Examples | | | | | | | | | | | | | | | |
| 1 | 12.5 | — | 1.0 | — | 1,2-propanediol | 1.0 | (1)*1 | 1.0 | (2)*2 | 1.0 | 0.9 | ○ | ◎ | 100 | 5 |
| 2 | 12.5 | — | 1.0 | — | 1,2,3-propanetriol | 1.0 | (1) | 1.0 | (2) | 1.0 | 0.9 | ○ | ◎ | 100 | 5 |
| 3 | 12.5 | — | 1.0 | — | 1,2-butanediol | 1.0 | (1) | 1.0 | (2) | 1.0 | 0.9 | ○ | ◎ | 100 | 5 |
| 4 | 12.5 | — | 1.0 | — | 1,2,4-butanetriol | 1.0 | (1) | 1.0 | (2) | 1.0 | 0.9 | ○ | ◎ | 100 | 5 |
| 5 | 12.5 | — | 1.0 | — | 1,2,3,4-butanetetraol | 1.0 | (1) | 1.0 | (2) | 1.0 | 0.9 | ○ | ◎ | 100 | 5 |
| 6 | — | 12.5 | 1.0 | — | 1,2,3-propanetriol | 1.0 | (1) | 1.0 | (2) | 1.0 | 0.9 | ○ | ◎ | 100 | 5 |
| 7 | 10.0 | 2.5 | 1.0 | — | 1,2,3-propanetriol | 1.0 | (1) | 1.0 | (2) | 1.0 | 0.9 | ○ | ◎ | 100 | 5 |
| 8 | 12.5 | — | 0.2 | — | 1,2,3-propanetriol | 1.0 | (1) | 1.0 | (2) | 1.0 | 0.9 | ◎ | ○ | 100 | 4 |
| 9 | 12.5 | — | 0.2 | — | 1,2,3-propanetriol | 0.1 | (1) | 1.0 | (2) | 1.0 | 0.9 | ○ | ○ | 100 | 4 |
| 10 | 12.5 | — | 1.0 | — | 1,2,3-propanetriol | 1.0 | (3)*3 | 1.0 | (2) | 1.0 | 0.9 | ○ | ◎ | 100 | 5 |
| 11 | 5.0 | — | 1.0 | — | 1,2-propanediol | 1.0 | (1) | 1.0 | (2) | 1.0 | 1.8 | ○ | ○ | 100 | 5 |
| 12 | 12.5 | — | 1.0 | — | 1,2,3-propanetriol | 1.0 | (1) | 0.25 | (2) | 0.25 | 0.9 | ◎ | ◎ | 100 | 5 |
| 13 | 12.5 | — | 1.0 | — | 1,2,3-propanetriol | 5.0 | (1) | 1.0 | (2) | 1.0 | 0.9 | ◎ | ◎ | 100 | 5 |
| 14 | 12.5 | — | 1.0 | — | 1,2-propanediol<br>1,2,3-propanetriol | 0.5<br>0.5 | (1) | 1.0 | (2) | 1.0 | 0.9 | ○ | ◎ | 100 | 5 |
| 15 | 12.5 | — | 1.0 | — | 1,2-propanediol<br>1,2,4-butanetriol | 1.0<br>1.0 | (1) | 1.0 | (2) | 1.0 | 0.9 | ◎ | ◎ | 100 | 5 |
| 16 | 10.0 | 2.5 | — | 1.0 | 1,2,3-propanetriol | 1.0 | (1) | 1.0 | (2) | 1.0 | 0.9 | ◎ | ◎ | 100 | 5 |
| Comparative Examples | | | | | | | | | | | | | | | |
| 1 | 12.5 | — | 1.0 | — | — | — | — | — | — | — | 0.9 | ◎ | Δ | 0 | 1 |
| 2 | 12.5 | — | 1.0 | — | — | — | (1) | 1.0 | (2) | 1.0 | 0.9 | x | ○ | 70 | 3 |
| 3 | 12.5 | — | 1.0 | — | 1,3-propandiol | 1.0 | (1) | 1.0 | (2) | 1.0 | 0.9 | x | ○ | 60 | 3 |
| 4 | 12.5 | — | 1.0 | — | 1,4-butanediol | 1.0 | (1) | 1.0 | (2) | 1.0 | 0.9 | x | ○ | 60 | 3 |
| 5 | 12.5 | — | 0.2 | — | — | — | (1) | 1.0 | (2) | 1.0 | 0.9 | Δ | Δ | 80 | 3 |
| 6 | 3.0 | — | 1.0 | — | 1,2-propanediol | 1.0 | (1) | 1.0 | (2) | 1.0 | 2.5 | ○ | Δ | 80 | 3 |

*1: Nonylphenol EO adduct compound (1),
*2: Hydrogen carbonate derivative (2),
*3: Abietic acid derivative (3)

etching amount is insufficient and the desmutting ability is reduced. More preferably, the treating time is 45 to 120 seconds.

After cleaning the aluminum surface by the acidic cleaning solution, the aluminum surface can further be treated according to an ordinary method, for example, phosphating after washing with water.

According to the present invention, since the oxidative decomposition reaction of the surfactant using the oxidizing agent is controlled by the polyhydric alcohol having at least two hydroxyl groups directly coupled with the two adjacent carbon atoms of the principal chain within one molecule, the oxidative decomposition products are accumulated in the cleaning bath and the degreasing ability is maintained the initial stage. Hence, the satisfactory cleaning of the aluminum surface can be attained.

The invention will be more clearly understood with reference to the following example. However, these examples are intended to illustrate the invention and are not to be construed to limit the scope of the invention.

Examples 1 to 16 and Comparative Examples 1 to 6

(1) Objects to be treated:

Lidless containers with lubricating oil and smut adhered thereto, obtained by the DI processing of 3004 alloy aluminum plate.

(2) Cleaning agent:

The acidic cleaning aqueous solution was the same as that used in (4) Oxidation efficiency evaluation described hereinafter. Before use, the ferrous ions ($Fe^{2+}$) or $Ce^{3+}$ were oxidized to the ferric ions ($Fe^{3+}$) or $Ce_{4+}$ in the acidic cleaning aqueous solution.

(3) Treating conditions:

The aforementioned containers were treated at 70° to 75° C. for 60 seconds by spraying acidic cleaning agent, were washed by spraying tap water for 15 seconds and then deionized water for 5 seconds, and were dried at 95° C.

(4) Oxidation efficiency evaluation:

As shown in Table 1, while acidic cleaning aqueous solutions containing predetermined amounts of components in Examples 1 to 16 and Comparative Examples 1 to 6 were heated to 70° C. and were stirred, hydrogen peroxide was dropped into the acidic cleaning aqueous solutions. Assuming that a theoretical necessary amount of the hydrogen peroxide and an actually used amount of the same were a and b, respectively, when all the ferrous ions ($Fe^{2+}$) or $Ce^{3+}$ were oxidized to the ferric ions ($Fe^{3+}$) or $Ce^{4+}$, oxidation efficiency was calculated according to the following equation.

$$\text{Oxidation efficiency}=(a/b)\times 100(\%)$$

⊙: 80 to 100(%)
○: 60 to 80(%)
○–Δ: 40 to 60(%)
Δ: 20 to 40(%)
X : 0 to 20(%)

(5) Cleaning power evaluation:

The following items were tested and the test result is shown in Table 1.

(a) External appearance:

The whiteness within the container after drying was determined with the eye. The white external appearance sufficiently etched with complete degreasing and desmutting was determined as good and the evaluation was divided into five stages depending on the degree of whitening as follows.

⊙: whole surface white
○: partially light gray
Δ: wholly light gray
X : partially gray
XX: wholly gray (b) Water wettability:

Right after washing by spraying water, the container was shaken three times to remove the water and was set down upright with its top on the upper side. After leaving for 30 seconds, the wet area (%) of the external surface of the container was measured.

(c) Desmutting ability:

After the container was dried, a transparent adhesive tape was stuck onto the internal surface of the container, was then pulled off and was stuck onto white cardboard.

The whiteness of the stuck tape was compared with that of the cardboard itself. The tape surface from which the smut was completely removed with no contamination was determined as good and the evaluation was divided into five stages depending on the degree of contamination as follows.

5: no contamination
4: traces of contamination
3: very small contamination
2: moderate contamination
1: large contamination The evaluation results are shown in Table 1. In Table 1, "ORP" represents an oxidation-reduction potential (silver-silver chloride electrode potential reference (vs. Ag/AgCl)) in the bath. The base of the acidic cleaning bath was 75% of sulfuric acid and 67.5% of nitric acid. The ferrous ions were supplied from ferrous sulfate ($FeSO_4.7H_2O$) and $Ce^{3+}$ from cerium nitrate ($Ce(NO_3)_3$).

It is readily understood from these results that by the acidic cleaning aqueous solution for aluminum and aluminum alloy and the cleaning method for the same, excellent cleaned aluminum surfaces can be obtained at a low temperature without using fluorine ions.

Example 17

(Performance Change By ORP Value)

In a similar manner to Example 1, in an aqueous solution (at a temperature of 70° C.) containing

| | |
|---|---|
| 1,2,3-propanetriol | 1.0 g/l, |
| $H_2SO_4$ | 12.5 g/l, |
| $Fe^{2+}$ | 1.0 g/l, |
| Nonylphenol EO adduct compound | 1.0 gl, and |
| Hydrogen carbonate derivative | 1.0 g/l, |

by adding $H_2O_2$, the performance at the oxidation-reduction potential of 0.60 V, 0.50 V and 0.45 V (vs. Ag/AgCl) was evaluated as follows.

| ORP (vs. Ag/AgCl) | External appearance | Water wettability | Desmutting ability |
|---|---|---|---|
| 0.60 V | ⊙ | 100 | 5 |
| 0.50 V | ○ | 100 | 4 |
| 0.45 V | Δ | 100 | 3 |

As described above, in the acidic cleaning aqueous solution for aluminum and aluminum alloy and the cleaning method for the same according to the present invention, the lubricating oil and the smut adhered to the aluminum surface can be removed at a low temperature without using harmful chromium and fluorine ions which cause a public hazard and the pollution of the working environment, to clean the aluminum surface so that the chemical conversion treatment and the coating can be carried out in a good condition.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An acidic cleaning aqueous solution for aluminum and aluminum alloy, comprising:

(a) at least one inorganic acid to produce a pH of at most 2 for the acidic cleaning aqueous solution;

(b) oxidized metal ions;

(c) at least one surfactant, and (d) 0.1 to 5 g/l of a mixture of at least one dihydric alcohol selected from the group consisting of 1,2-butanediol and 1,2-pentanediol and at least one trihydric alcohol having at least two hydroxyl groups directly coupled with respect to two adjacent carbon atoms of a principal chain within one molecule.

2. The acidic cleaning aqueous solution according to claim 1, wherein the trihydric alcohol includes at least one of 1,2,3-propanetriol and 1,2,4-butanetriol.

3. The acidic cleaning aqueous solution according to claim 1, wherein (a) the inorganic acid includes at least one of sulfuric acid, nitric acid and phosphoric acid.

4. The acidic cleaning aqueous solution according to claim 1, wherein (b) the oxidized metal ions include at least one of ferric ions, metavanadic ions, ceric ions, cobalt (V) ions and tin (IV) ions.

5. The acidic cleaning aqueous solution according to claim 1, wherein (c) the surfactant is a nonionic surfactant.

6. The acidic cleaning aqueous solution according claim 1 further comprising an oxidation-reduction potential control oxidizing agent.

7. The acidic cleaning aqueous solution according to claim 6, wherein the oxidation-reduction potential control oxidizing agent includes at least one of hydrogen peroxide, persulfates, ozone, and nitrites.

8. The acidic cleaning aqueous solution according to claim 1, wherein (a) the inorganic acid is sulfuric acid;

(b) the oxidized metal ions include at least one of ferric ions and metavanadic ions (c) the surfactant is a nonionic surfactant; and (d) the trihydric alcohol includes at least one of 1,2,3-propanetriol and 1,2,4-butanetriol.

9. The acidic cleaning aqueous solution according to claim 1, wherein a content of (d) the mixture of dihydric and trihydric alcohols in the acidic cleaning aqueous solution is 0.2 to 3 g/l.

10. The acidic cleaning aqueous solution according to claim 1, wherein an amount of (a) the inorganic acid in the acidic cleaning aqueous solution is determined so that the pH of the acidic cleaning aqueous solution is within a range of 0.6 to 2.0;

a content of (b) the oxidized metal ions in the acidic cleaning aqueous solution is 0.2 to 5 g/l;

a content of (c) the surfactant in the acidic cleaning aqueous solution is 0.2 to 5 g/l; and a content of (d) the mixture of dihydric and trihydric in the acidic cleaning aqueous solution is 0.2 to 3 g/l.

* * * * *